United States Patent [19]

Lepley

[11] Patent Number: 4,512,703

[45] Date of Patent: Apr. 23, 1985

[54] BOTTOM SILO UNLOADER

[75] Inventor: James W. Lepley, Smithville, Ohio

[73] Assignee: Flying Dutchman, Inc., Smithville, Ohio

[21] Appl. No.: 513,714

[22] Filed: Jul. 14, 1983

[51] Int. Cl.[3] ..... B65G 3/10

[52] U.S. Cl. ..... 414/288; 137/312; 222/108; 222/556; 251/299

[58] Field of Search ..... 414/288, 292, 324, 199, 414/200; 222/108, 505, 556; 137/312; 251/299

[56] References Cited

U.S. PATENT DOCUMENTS

| | | | |
|---|---|---|---|
| 2,654,388 | 10/1953 | Glass | 137/312 |
| 3,710,960 | 1/1973 | Stauffer et al. | 414/324 |
| 4,306,828 | 12/1981 | Legille et al. | 414/199 |

*Primary Examiner*—Robert G. Sheridan

*Attorney, Agent, or Firm*—Mason, Kolehmainen, Rathburn & Wyss

[57] ABSTRACT

A silo unloader for unloading silage from a discharge opening in a bottom wall thereof includes a housing mounted in the opening having a downwardly extending discharge chute. The chute includes an inner sloping wall having a lower drip edge and a pair of side walls joined thereto with side edges sloping upwardly with respect to the drip edge in a direction opposite that of the sloping wall. The side edges define lower edges of a discharge outlet of the chute. A discharge door is mounted to pivot between an open and a closed position with respect to the discharge outlet and the door includes a resilient gasket around the perimeter adapted to provide an air-tight seal for the outlet when the door is closed. The discharge chute includes a lower sealing bar joined at opposite ends to the sidewalls, and spaced below and horizontally offset from the drip edge so that material falling over the drip edge does not interfere with establishing a tight seal when the door is closed. The discharge door is designed to be in clear view in all operative positions so that a visual check can be made to see that a tight seal is established. If silage or other material is hanging from the drip edge in a manner which might prevent a tight seal, the material is readily cleared away while the door is open before closing the door to establish the seal.

14 Claims, 6 Drawing Figures

BOTTOM SILO UNLOADER

BACKGROUND OF THE INVENTION

A. Field of the Invention

The present invention relates to bottom silo unloaders and more particularly to a new and improved silo unloader specially designed to provide easy visual inspection to insure that a tight seal is established when the discharge door is closed. Moreover, the novel silo unloader includes a discharge outlet having a drip edge spaced upwardly and offset from a lower sealing bar so that material hanging from the drip edge does not interfere with a tight seal formed around a periphery of the door when the door is closed.

B. Description of the Prior Art

In agricultural silos and storage enclosures it is necessary and desirable to provide means for rapid discharge of the contents thereof when desired and to provide airtight sealing of the discharge opening when the material is stored so that spoilage will not result.

A number of bottom silo unloaders of the type employing flail chains for digging out and discharging silage through a discharge opening in the bottom wall of the silo have been developed and U.S. Pat. Nos. 3,710,960, 3,710,986, 3,809,260, 3,828,946, 3,828,947, 3,837,507, 3,907,131 and 4,079,848 are directed to unloaders of this type. In particular, the latter patent discloses a bottom silo unloader having a pivotable discharge door for opening and closing a discharge opening in a housing or discharge chute structure.

OBJECTS OF THE INVENTION

It is an object of the present invention to provide a new and improved silo unloader of the character described having novel structure for establishing a tight seal around a discharge outlet when the discharge door is closed.

Moreover, it is another object of the present invention to provide a new and improved bottom type silo type unloader of the character described wherein the discharge door is easily viewed in all operative positions to ascertain whether or not silage or other material is obstructing and preventing a good, tight seal when the door is closed.

Yet, another object of the present invention is to provide a new and improved bottom silo unloader of the character described having a discharge chute with a lower drip edge spaced above and offset horizontally from a lower sealing bar of the door so that any silage or other material hanging down from the discharge edge or drip edge does not interfere with establishment of a tight seal when the discharge door is closed.

BRIEF SUMMARY OF THE INVENTION

Foregoing objects and other advantages of the present invention are accomplished in an illustrated embodiment comprising a silo unloader of the character described adapted for unloading a silo from a discharge opening in a bottom wall thereof. The unloader includes a housing mounted in the discharge opening having a downwardly extending discharge chute. The discharge chute includes a sloping wall having a lower drip edge and a pair of side walls joined thereto with side edges sloping upwardly of the drip edge in a direction opposite that of the sloping wall. A disharge door is mounted to pivot between an open and a closed position with respect to a discharge outlet defined by the side edges of the chute. The door is provided with a resilient sealing gasket around an inner face for establishing a tight seal for the outlet of the chute when the door is closed. The chute includes a lower sealing bar joined at opposite ends to the sidewalls and spaced below and horizontally offset from the drip edge of the sloping wall so that material hanging from the drip edge will not interfere with establishing a tight seal when the door is closed. An upper sealing bar is provided at the upper end of the door so that a complete peripheral seal around the discharge outlet may be established when the door is closed. The door is positioned in clear view in all operative positions so that silage or other material which might otherwise interfere with a tight seal when the door is closed may be detected and removed insuring that a good seal may be established.

BRIEF DESCRIPTION OF THE DRAWING

For a better understanding of the present invention reference should be had to the following detailed description taken in conjunction with the drawings, in which.

DESCRIPTION OF A PREFERRED EMBODIMENT OF THE INVENTION

Figure 1:
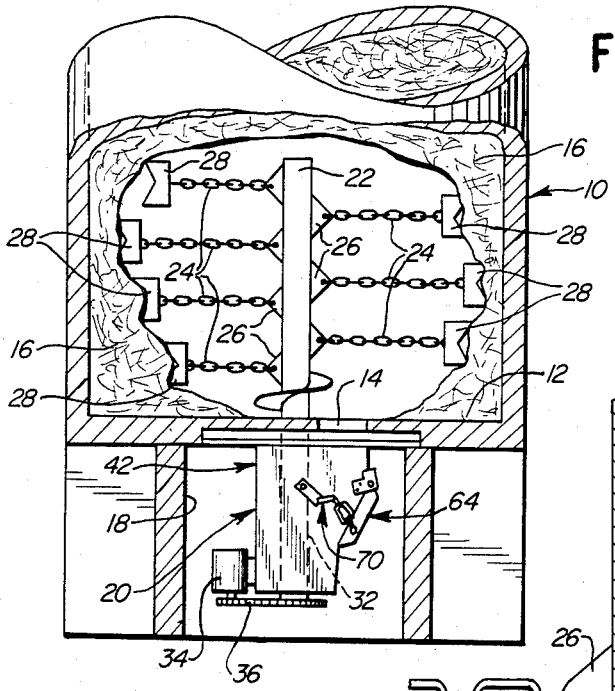
FIG. 1 is an elevational, cross-sectional view illustrating a bottom unloading silo having a silage unloader mounted therein constructed in accordance with the features of the present invention.
Figure 2:
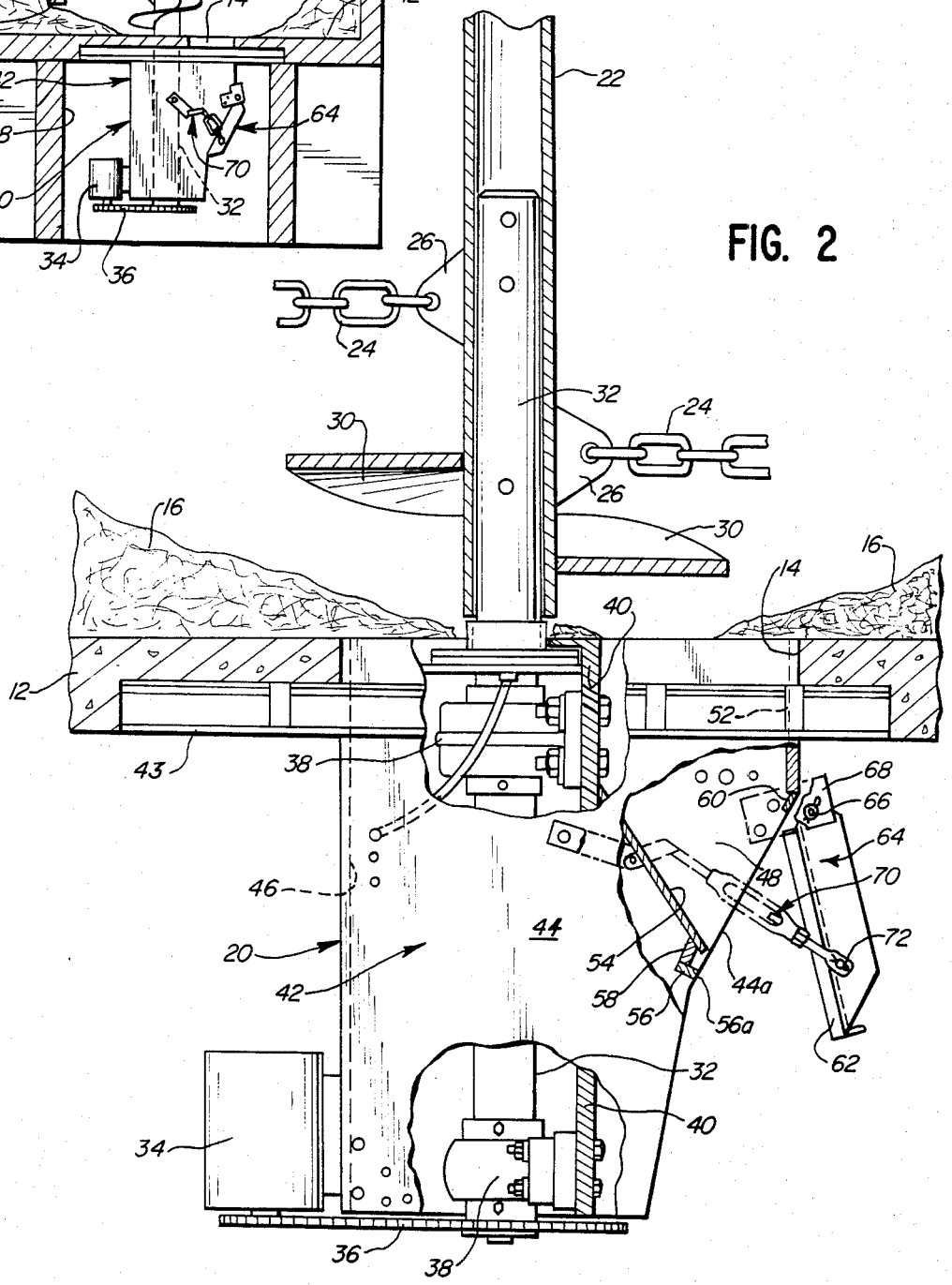
FIG. 2 is an enlarged, fragmentary, vertical elevational view with portions shown in section illustrating the silo unloader of FIG. 1 in enlarged detail.

Referring now more particularly to the drawings, in FIG. 1 is illustrated a lower end portion of a typical agricultural silo 10 having a bottom wall 12 with a central discharge opening 14 formed therein for the discharge or unloading of silage material 16 that is stored or contained in the silo. Directly below the discharge opening 14 is provided an open space or unloading compartment 18 and a new and improved bottom silo unloader 20 is mounted in the central opening 14 of the bottom wall of the silo in the unloading compartment.

The silo unloader 20 is a flail type unloader which includes an upstanding rotating shaft 22 having a plurality of flail chains 24 secured to radial wings 26 thereon at vertically spaced intervals. At the outer end, each chain is provided with a cutter 28 adapted to engage and dislodge the silage 16 from the bottom of the mass of material contained in the silo. The dislodged silage is eventually directed by the flail chains and a central auger 30 to a central position so that the material may flow downwardly through the discharge opening 14 in the silo bottom wall.

The central hollow shaft 22 is driven by an upstanding internal shaft 32 secured thereto and powered by an electric motor 34 or other power source through a chain drive, speed reducing, power train 36 at the lower end of the shaft. The central shaft is supported for rotation on upper and lower bearings 38 which are mounted on an internal wall structure 40 in a main unloader housing 42 which depends downwardly from a supporting frame structure 43 directly below the discharge opening 14 in the silo bottom wall 12.

Figure 4:
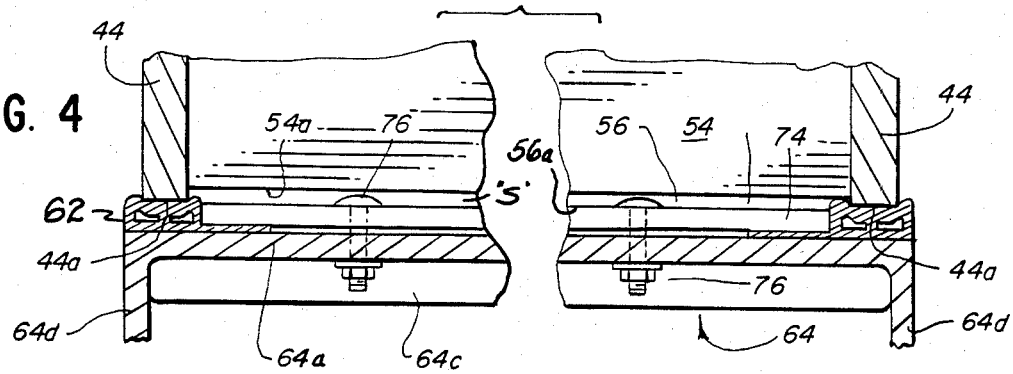
FIG. 4 is a transverse cross sectional view taken substantially along lines 4—4 of FIG. 3.
Figure 4A:
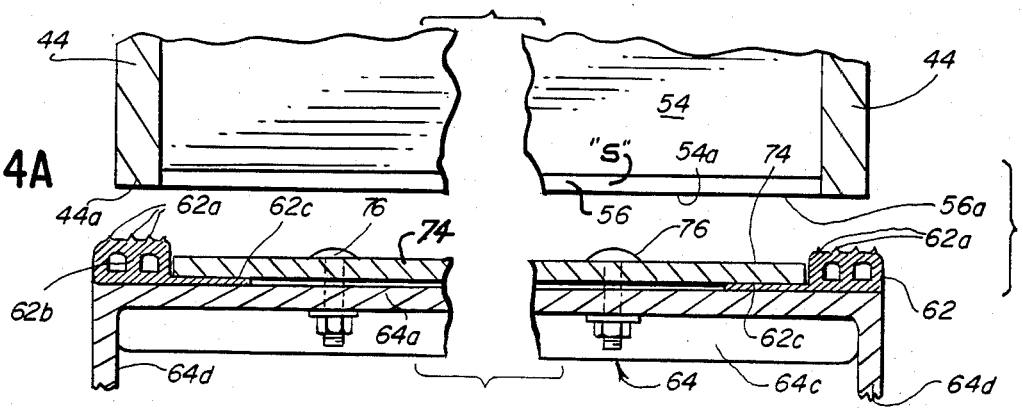
FIG. 4A is a transverse cross sectional view taken substantially along lines 4A of FIG. 3A.

The housing includes a pair of spaced apart opposite vertical side walls 44, an internal vertical transverse wall 40 and an outer transverse or back wall 46 which serves as a supporting base for the motor 34. Upper portions of the sidewalls 44 form the opposite side walls of a silage discharge chute 48 having a pair of upper, transverse vertical walls 40 and 52 and a lower, sloping internal sidewall 54 having a lower drip edge **54*a* (FIGS. 4 and 4A). The drip edge is spaced a distance "S" above a sloping edge portion 44*a* defined on the upper portion of the vertical sidewalls 44**.

Figure 3:
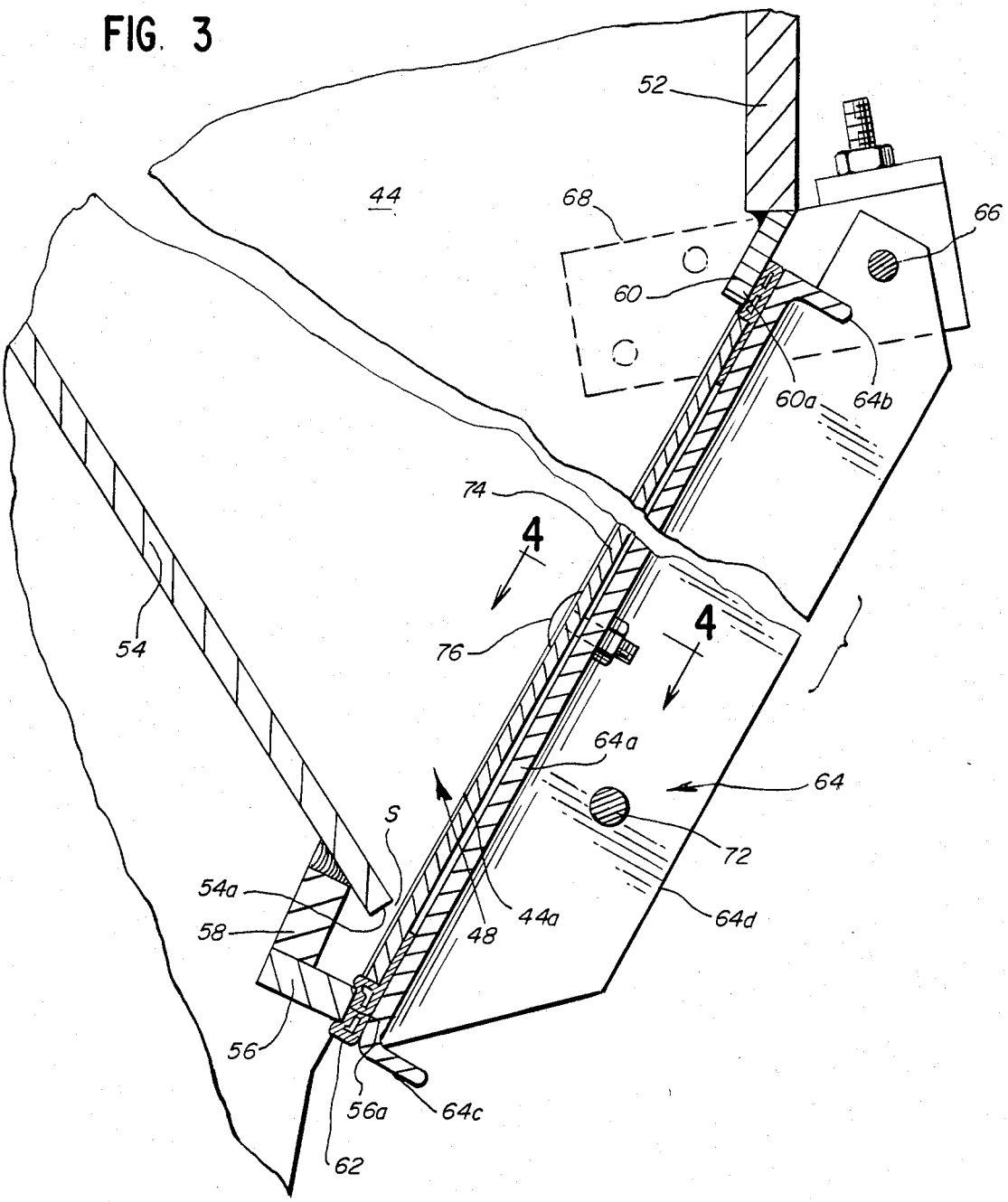
FIG. 3 is a greatly enlarged, fragmentary vertical cross sectional view illustrating the discharge outlet and discharge door of the unloader in a closed position.
Figure 3A:
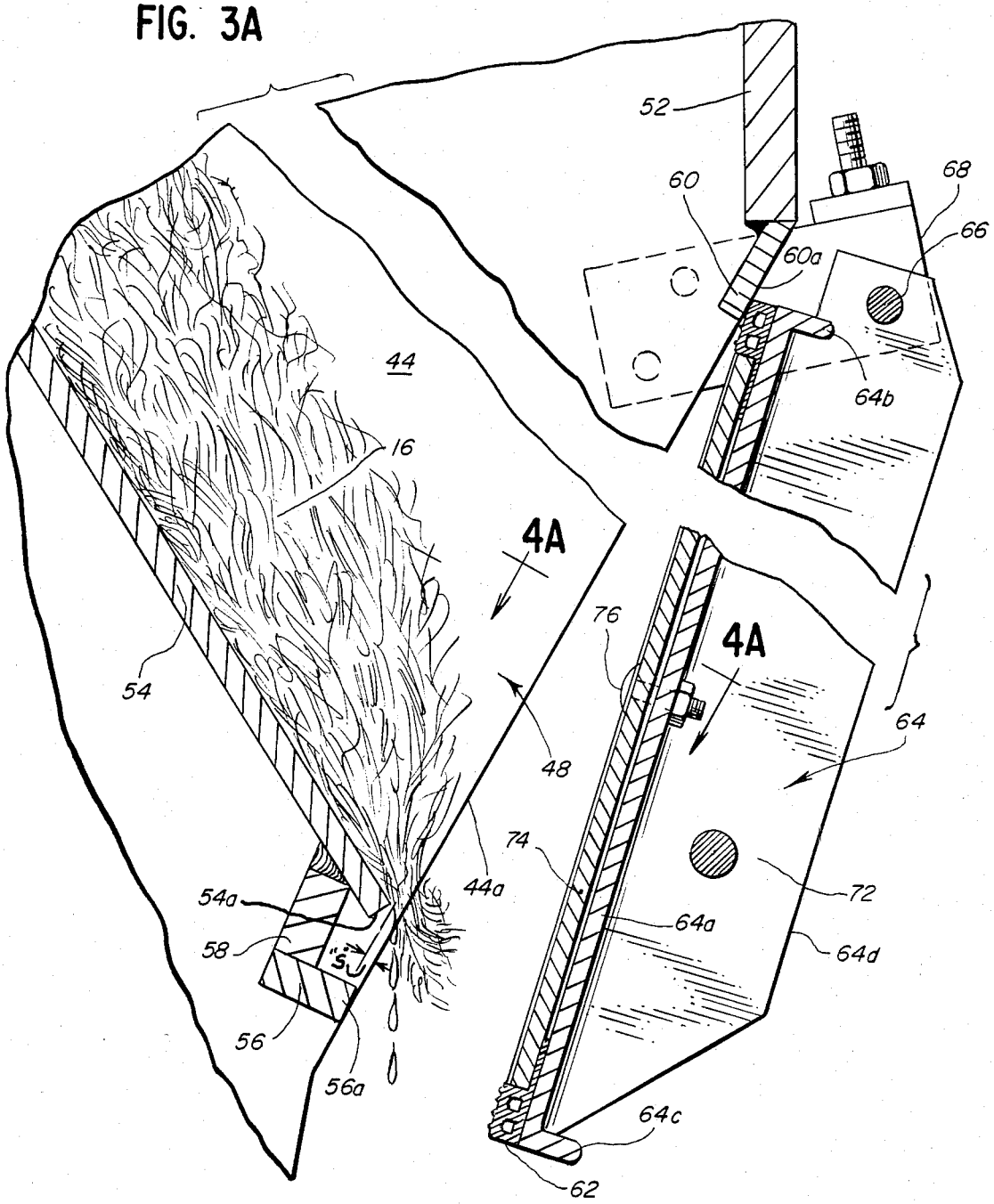
FIG. 3A is a cross sectional view similar to FIG. 3 but illustrating the discharge door in an open position.

In accordance with the present invention, the discharge outlet is provided with a lower transverse sealing bar 56 having a lower sealing edge **56*a* which is spaced below and offset horizontally from the drip edge 54*a* of the sloping inner wall 54. As best shown in FIGS. 3 and 3A, the lower sealing edge 56*a* is even or aligned on the same plane as the edges 44*a* of the sidewalls 44 (as best shown in FIGS. 3A and 4A). The lower sealing bar 56 is secured to a filler element 58 at right angles thereto as by welding and an upper edge of the filler element is welded or otherwise joined to the underside of the sloping inner wall 54**.

The discharge chute 48 is also provided with an upper transverse sealing bar 60 having a lower face or surface **60*a* that is flush or even with the intersecting surfaces 44*a* of the sidewalls 44. Accordingly, a lower, discharge outlet is established with a rectangular shaped perimeter formed by the sidewall edge surfaces 44*a*, the lower sealing bar edge 56*a* at the lower end, and the face 60*a* of the upper bar 60 at the upper end of the opening. These edge surfaces lie on a common sealing plane spaced below the drip edge 54*a* and are adapted to sealingly engage a peripheral door gasket 62 mounted on the peripheral edge of the inner face of a pivotable discharge door 64**.

The door is adapted to open and close the discharge outlet of the discharge chute 48 and includes a rectangular body **64*a* edged by outwardly extending, upper and lower edge flanges 64*b* and 64*c*, respectively, and a pair of larger, opposite side flanges 64*d*** which provide a strong and stiff discharge door structure.

The door is mounted for pivotal movement on a horizontal axle pin 66 supported on a pair of brackets 68 secured to the opposite sidewalls 44 of the discharge chute. The axle pin 66 extends through an upper portion of the side flanges **64*d* and is parallel of and spaced upwardly of the upper edge flange 64*b* of the door as best shown in FIG. 3. The door 64 is movable between a closed position shown in FIG. 3 and an open position shown in FIG. 3A. In the closed position, the peripheral sealing gasket 62 around the perimeter of the door base 64*a* is compressed and tightly sealed against the edge surfaces 44*a*, 56*a* and 60*a*** which form the outlet perimeter of the discharge chute. The tight seal generally prevents the silage or other material in the silo from being exposed to oxygen in the outside air and thus reduces spoilage and loss.

In an open or discharge position as shown in FIG. 3A, silage or other material in the silo is dislodged by the chains of the unloader during operation and the material falls downwardly into the chute 48 and out through the discharge outlet at the lower end. Pivotal movement of the door between the open and closed positions is mechanically controlled by arm linkages 70 which are pivotally interconnected to pins 72 on opposite side flanges **64*d*** of the door.

The resilient peripheral sealing gasket 62 is formed of silicone rubber or other resilient material able to withstand prolonged contact with silage and other materials that are to be stored in the silo. The gasket is uniquely shaped in transverse cross section as shown best in FIG. 4A and includes a plurality of longitudinally extending sealing ribs or ridges **62*a* along an outer sealing surface for providing a good, tight seal against the metal edges of the discharge chute outlet. The sealing gasket is formed with a hollow interior which is separated into two hollow passages by a central rib 62*b*. An integral mounting flange 62*c* extends inwardly from the inside edge of the main body of the gasket. The flange is clamped in place against the door base 64*a* by means of an inner clamping or pressure plate 74, also of rectangular shape and smaller than the door base. The clamping plate is held in place by a plurality of cap screws and nuts 76**.

When the door is closed to seal as shown in FIGS. 3 and 4, the resilient sealing gasket 62 around the periphery of the inner surface of the door body **64*a* is compressed slightly as shown to effect a tight peripheral seal and the ridges 62*a* on the sealing gasket are effective in providing excellent sealing action. As shown in FIG. 4, the transverse cross section of the gasket is deformed slightly when the seal is established and the central rib 62*b*** of the gasket provides stiffness for sealing pressure in the central portion of the gasket bearing against the edges of the discharge chute.

The door 64 is in clear view in all operative positions and a visual inspection can easily ascertain whether or not a tight seal is established because of the slight bulge in the outside edges of sealing gasket. If there is silage or other material hanging downwardly of the drip edge **54*a* and this is likely to prevent a tight seal from being established, the silage is easily detected when the door is open so that an operator may readily clear away the silage before shutting the door. Because the lower drip edge 54*a* of the sloping wall 54 is spaced upwardly and offset horizontally from the lower sealing edge 56*a* of the lower sealing bar 56, most of the silage falls freely downward when the door is open and does not tend to collect and hang on any structure of the unloader. Small amounts of material or silage on the drip edge can be tolerated, however, without interfering with the establishment of a seal between the lower edge of the sealing gasket 62 and the lower sealing bar edge 56*a*** because of the spaced offset between the drip edge and the lower sealing bar.

The silo unloader 20 thus provides a unique and useful system for sealing tightly the lower discharge outlet at the bottom end of a silo and permits a clear and easy visual inspection to insure that a good seal is established and maintained. Moreover, opening and closing of the discharge door is simplified because of the vertical and horizontal offset between the lower drip edge **54*a* and the lower sealing bar 56**.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A silo unloader for unloading silage contained in a silo through a discharge opening formed in a lower wall of the silo said unloader comprising:

a housing adapted to be mounted adjacent said discharge opening for receiving silage from the silo and including a discharge chute for said silage extending downwardly of said opening, said chute including a sloping bottom wall terminating at a lower end forming a horizontal drip edge, and a pair of sidewalls extending upwardly along opposite sides of said sloping bottom wall, said sidewalls having free outer side edges spaced outwardly of said drip edge and sloping upwardly and outwardly away from said bottom wall and said horizontal drip edge, said free edge side edges defining opposite sides of a discharge outlet for silage and the like to be unloaded from said silo, a discharge door mounted to pivot about a horizontal axis above said drip edge between open and closed positions with respect to said discharge outlet, said door having an inside surface spaced apart from said drip edge when said door is closed, resilient sealing means adjacent edge portions of said door for sealing said discharge outlet when said door is closed, and said chute including a lower sealing bar forming a lower edge of said discharge opening extending between said free outer side edges of said sidewalls, said sealing bar having a lower edge spaced below said drip edge and adapted to engage a lower edge portion of said sealing means when said discharge door is in said closed position, said drip edge being positioned in spaced apart relation inwardly of an inside face of said discharge door when said door is sealed in said closed position whereby any silage hanging over said drip edge does not prevent tight sealing along said lower edge of said discharge opening.

2. The silo unloader of claim 1 wherein said lower edge of said sealing bar is even with said side edges of said sidewalls.

3. The silo unloader of claim 1 wherein said drip edge is spaced upwardly of said side edges of said sidewalls.

4. The silo unloader of claim 1 wherein side edge portions of said sealing means are sealed against said free outer side edge of said sidewalls when said discharge door is in said closed position.

5. The silo unloader of claim 1 wherein said discharge chute includes an upper sealing bar extending between said sidewalls and having a lower edge positioned to seal with an upper edge portion of said sealing gasket means when said discharge door is in said closed position.

6. The silo unloader of claim 5 wherein said lower edge of said upper sealing bar is even with said free outer side edges of said sidewalls.

7. The silo unloader of claim 6 wherein said discharge door is positioned beneath said sloping free outer side edges of said sidewalls.

8. The silo unloader of claim 7 wherein said discharge door is mounted for pivotal movement about a pivot axis adjacent an upper end portion of said door.

9. The silo unloader of claim 8 wherein said pivot axis is spaced below said sloping free outer side edges of side sidewalls.

10. The silo unloader of claim 1 wherein said sealing means comprises a gasket extending along edge portions of said door on an inside face thereof.

11. The silo unloader of claim 10 wherein said gasket includes an integral mounting flange along an inside edge adapted to be clamped against an inside surface of said door.

12. The silo unloader of claim 10 wherein said gasket includes a sealing face for contact against the edges forming said discharge opening having at least one longitudinally extending sealing ridge thereon.

13. The silo unloader of claim 10 wherein said gasket includes a body having at least one longitudinally extending hollow passage therein.

14. The silo unloader of claim 13 wherein said gasket body includes a pair of longitudinally extending hollow passages on opposite side of an integral rib.

* * * * *